US009046326B1

(12) United States Patent
Rothman et al.

(10) Patent No.: US 9,046,326 B1
(45) Date of Patent: Jun. 2, 2015

(54) BALLISTIC LAMINATE STRUCTURE, AND METHOD FOR MANUFACTURING A BALLISTIC LAMINATE STRUCTURE

(76) Inventors: Miles S. Rothman, Sun Lakes, AZ (US); Alexander Watson, Chesterfield, VA (US); Kenneth Herbert Keuchel, Hudson, OH (US)

( * ) Notice: Subject to any disclaimer, the term of this patent is extended or adjusted under 35 U.S.C. 154(b) by 722 days.

(21) Appl. No.: 13/065,559

(22) Filed: Mar. 24, 2011

Related U.S. Application Data

(60) Provisional application No. 61/317,186, filed on Mar. 24, 2010.

(51) Int. Cl.
*F41H 5/06* (2006.01)
*F41H 5/04* (2006.01)

(52) U.S. Cl.
CPC ..... *F41H 5/0485* (2013.01)

(58) Field of Classification Search
USPC ..... 89/36.05, 36.02, 915
See application file for complete search history.

(56) References Cited

U.S. PATENT DOCUMENTS

| | | | | | |
|---|---|---|---|---|---|
| 3,589,956 | A | | 6/1971 | Kranz et al. | |
| 3,826,172 | A | * | 7/1974 | Dawson | 89/36.02 |
| 3,988,519 | A | * | 10/1976 | Stoller | 428/15 |
| 4,457,985 | A | * | 7/1984 | Harpell et al. | 442/301 |
| 4,636,422 | A | * | 1/1987 | Harris et al. | 428/174 |
| 4,819,458 | A | * | 4/1989 | Kavesh et al. | 66/202 |
| 5,306,557 | A | * | 4/1994 | Madison | 428/304.4 |
| 5,437,905 | A | * | 8/1995 | Park | 428/105 |
| 5,543,194 | A | * | 8/1996 | Rudy | 428/69 |
| 5,935,678 | A | * | 8/1999 | Park | 428/105 |
| 6,562,435 | B1 | * | 5/2003 | Brillhart et al. | 428/105 |
| 7,148,162 | B2 | * | 12/2006 | Park et al. | 442/134 |

* cited by examiner

*Primary Examiner* — Reginald Tillman, Jr.
(74) *Attorney, Agent, or Firm* — Schwartz Law Firm, P.C.

(57) ABSTRACT

A ballistic laminate structure in sheet form includes first and second pre-annealed nonwoven fabric layers. Each fabric layer is constructed of a loosely assembled array of unidirectionally-oriented, untwisted, high performance fibers. The layers are joined together at an angle to form a dimensionally stable cross-plied fabric.

20 Claims, 4 Drawing Sheets

BALLISTIC LAMINATE STRUCTURE, AND METHOD FOR MANUFACTURING A BALLISTIC LAMINATE STRUCTURE

TECHNICAL FIELD AND BACKGROUND OF THE INVENTION

This invention relates generally to a ballistic laminate structure in sheet form, a ballistic panel constructed of a plurality of the sheets, a ballistic garment constructed of one or more of the ballistic panels, and a method of manufacturing a ballistic laminate structure.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a ballistic laminate structure in sheet form. The ballistic structure includes first and second pre-annealed nonwoven fabric layers, each comprising a loosely assembled array of unidirectionally-oriented, untwisted, high performance fibers. The layers are joined together at an angle to form a dimensionally stable, unitary cross-plied fabric. The means for joining may comprise, for example, heat-activated thermoplastic films, resins, glues, open-weave scrims, stitching, ultrasonic bonding, point bonding, autogenous bonding, or the like. The term "dimensionally stable" refers to the ability of resulting cross-plied fabric (incorporating the pre-annealed first and second fabric layers) to maintain its geometric configuration, such as without substantial shrinkage. The high performance fibers may comprise continuous filament fibers.

As used herein, the term "continuous filament" or "continuous fibers" refers to filaments or fibers that have a generally high aspect ratio (length/diameter) such as, for example, exceeding about 500,000/1.

The "high performance fiber" may have a tensile strength greater than 7 grams per denier.

The term "unidirectional" and "unidirectionally-oriented" refers to a substantially parallel (side-by-side) arrangement of untwisted continuous fibers. Unidirectional fabric layers constructed of unidirectional fibers may have no fill yarns (or only a small fill count) such that substantially all of the fibers run in the machine direction.

The term "machine direction" means the longitudinal direction in which the fabric or fabric layers are produced (e.g., the longitudinal direction of the uni-directionally oriented fibers).

The term "laminate" refers to a fabric or fabric structure incorporating two or more layers or materials assembled together in complete or partial overlying arrangement.

According to another exemplary embodiment, the first pre-annealed fabric layer comprises high performance fibers annealed at a temperature sufficient to shrink the fabric layer in a machine direction. As a result of pre-annealing, the first fabric layer may shrink at least 1.5% in the machine direction.

According to another exemplary embodiment, the second pre-annealed fabric layer comprises high performance fibers annealed at a temperature sufficient to shrink the fabric layer in a machine direction. As a result of pre-annealing, the second fabric layer may shrink at least 1.5% in the machine direction.

According to another exemplary embodiment, a thermoplastic layer resides outside of at least one of the first and second pre-annealed fabric layers.

According to another exemplary embodiment, a thermoplastic layer resides between the first and second pre-annealed fabric layers.

According to another exemplary embodiment, a thermoplastic layer resides adjacent at least one of the first and second pre-annealed fabric layers. The thermoplastic layer may comprise a nonwoven fibrous heat-activated resin selected from a group consisting of polyethylene and ethylene-vinyl-acetate. Alternatively, the thermoplastic layer may comprise an open-weave or mesh scrim.

According to another exemplary embodiment, the first pre-annealed fabric layer is cross-plied at an angle of 90 degrees to the second pre-annealed fabric layer.

According to another exemplary embodiment, a percentage by weight of the high performance fibers in the ballistic laminate structure is at least 80 percent of a total weight of the ballistic laminate structure.

According to another exemplary embodiment, the fibers of the first and second pre-annealed fabric layers are chosen from a group consisting of aramid fiber, polyolefin, vinylon, and liquid crystal polymer-based fiber.

According to another exemplary embodiment, the fibers of the first and second pre-annealed fabric layers are chosen from a group consisting of extended chain ultra-high molecular weight polyethylene (UHMWPE), poly{p-phenylene-2,6-benzobisoxazole} (PBO), and poly{diimidazo pyridinylene (dihydroxy)phenylene} (M5).

In yet another exemplary embodiment, the present disclosure comprises a ballistic article incorporating a stacked assembly of ballistic laminate structures as described herein. The ballistic article may comprise a small arms protective insert (SAPI or ESAPI). The exemplary protective insert may have a ceramic facing.

In yet another exemplary embodiment, the present disclosure comprises a method for manufacturing a ballistic laminate structure in sheet form. The method includes pre-annealing first and second fabric layers (e.g., separately or individually); each layer comprising a loosely assembled array of unidirectionally-oriented, untwisted, high performance fibers. After pre-annealing the first and second fabric layers, the first and second fabric layers are jointed together at an angle to form a dimensionally stable cross-plied fabric. The fabric layers may be joined together (or laminated) under heat and pressure. Alternatively, the fabric layers may be formed together by ultrasonic bonding, point bonding, autogenous bonding, stitching, or the like.

According to another exemplary embodiment, pre-annealing the first fabric layer comprises heating the fibers at a temperature sufficient to shrink the fabric layer in a machine direction.

According to another exemplary embodiment, pre-annealing the second fabric layer comprises heating the fibers at a temperature sufficient to shrink the fabric layer in a machine direction.

BRIEF DESCRIPTION OF THE DRAWINGS

The present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
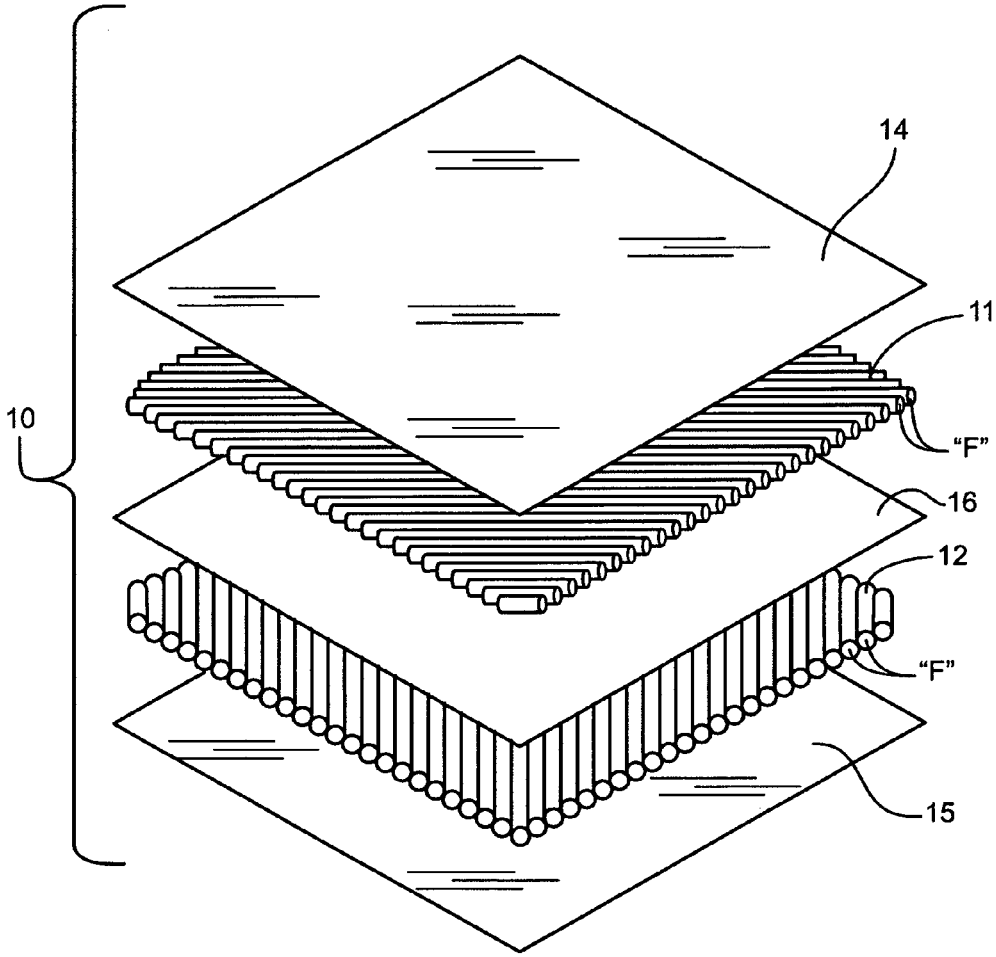
FIG. 1 is a perspective view of a ballistic laminate structure according to one exemplary embodiment of the present disclosure, and showing the various layers of the laminate structure separated for purposes of illustration.

Referring now specifically to the drawings, an exemplary ballistic laminate structure according to the present disclosure is illustrated in FIG. 1, and shown generally at reference numeral 10. The laminate structure 10 comprises an assembly of overlying pre-annealed fabric layers 11, 12 and thermoplastic layers 14, 15, and 16. Each pre-annealed fabric layer 11, 12 incorporates a loosely assembled array of unidirectionally-oriented, untwisted, high performance fibers "F". The high performance fibers "F" may comprise a strain crystallized high-modulus thermoplastic. The strain crystallization process involves stretching and heating the fibers to produce a so-called "shish kabob" molecular structure. Alternatively, the high performance fibers "F" may comprise a high modulus polypropylene (HMPE) sold under the registered trademark Innegra® S by Innegrity LLC, of Simpsonville, S.C. U.S. Pat. No. 7,074,483 assigned to Innegrity LLC describes various methods and apparatus related to the production of HMPE fibers, the entire contents of which are hereby incorporated by reference.

Other examples of high performance fibers "F" include S-glass composed of silica (SiO2), alumina (Al2O3), and magnesia (MgO); aramid fibers, such as commercially-known Twaron®, Technora®, and DuPont's Kevlar® 29, Kevlar® 49, Kevlar® 129, and Kelvar® KM2; high molecular weight polyethylene (HMWPE), such as commercially-known Spectra® and Dyneema®; polybenzobisoxazole (PBO) fibers, such as commercially-known Zylon®; and polypyridobisimidazole (PIPD), such as commercially-known M5®. These fibers have high tensile strength, elastic modulus, and strain to failure. For example, such high performance fibers "F" may have a tensile strength greater than about 2000 MPa and an elastic modulus greater than about 60 GPa.

Figure 2:
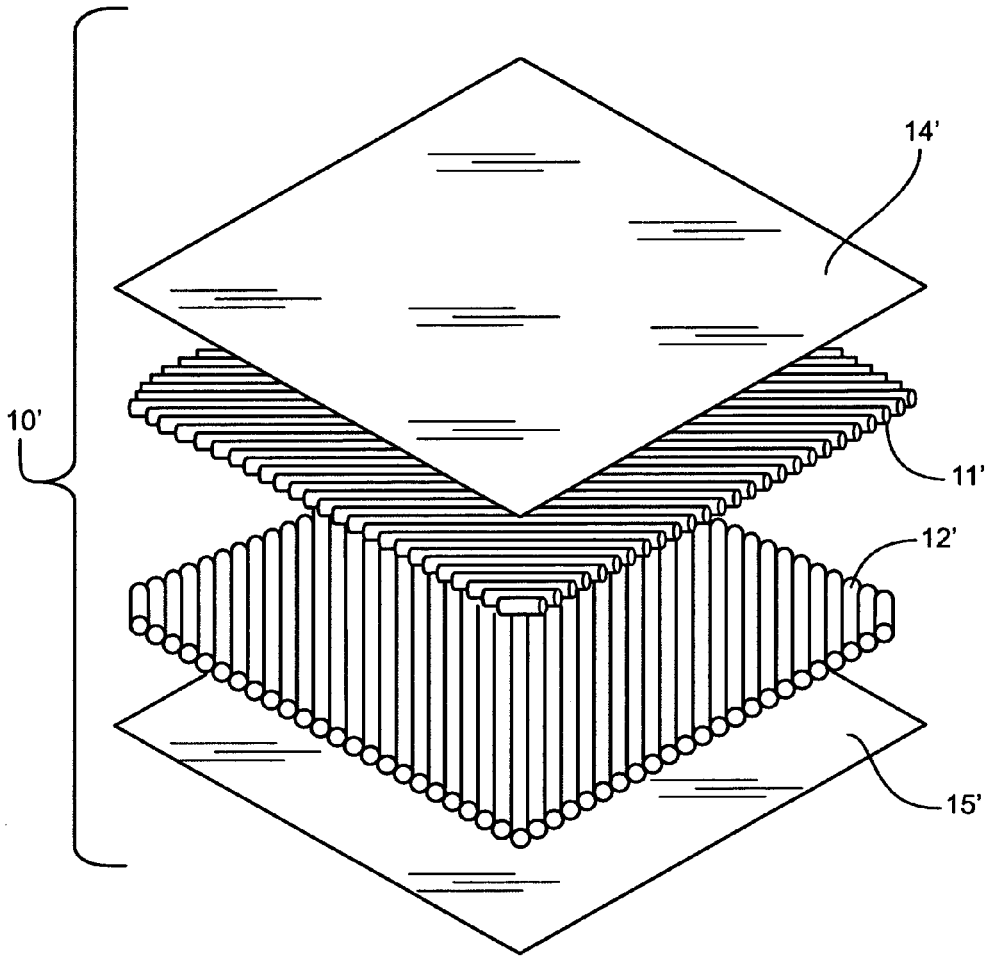
FIG. 2 is a flowchart representation of the basic process of forming the exemplary ballistic laminate structure.

In the exemplary embodiment, the thermoplastic layers 14, 15, 16 reside outside and between the pre-annealed fabric layers, respectively. Suitable thermoplastic materials may include various polyolefins, including vinyl chain-growth polymers, such as polyethylene and polypropylene, open-weave or mesh fibrous scrims, and other thermoplastics films, resins, and coatings. Alternatively, as shown in FIG. 2, the pre-annealed fabric layers 11' and 12' of the laminate structure 10' may be cross-plied and laminated together with thermoplastic layers 14' and 15', but without additional thermoplastic, resin or other bonding agent between the layers 11', 12'.

Figure 3:
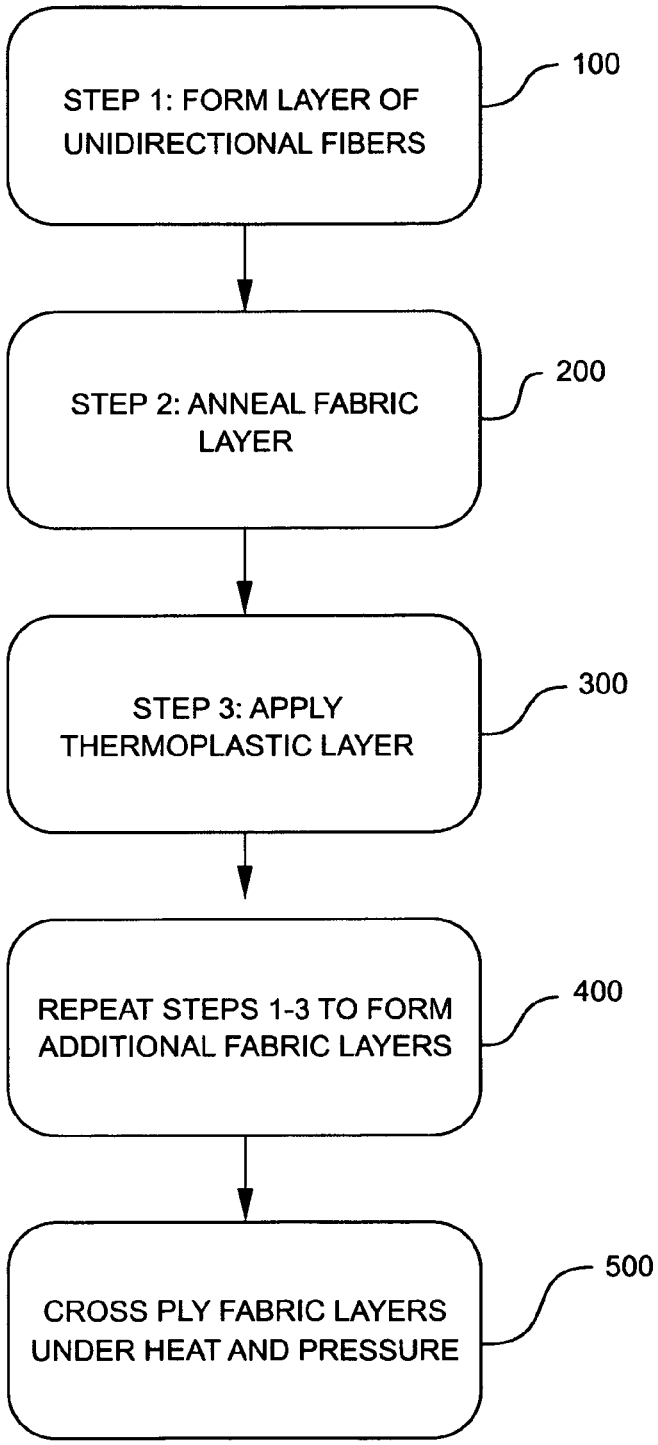
FIG. 3 is a perspective view of a ballistic laminate structure according to an alternative exemplary embodiment of the present disclosure.

The exemplary ballistic laminate structure 10 may be fabricated according to the process outlined in FIG. 3. Although the discussion below references laminate structure 10, this same exemplary process may be used to form laminate structure 10'. As indicated at block 100, the first step in the process is to form the first nonwoven unidirectional fabric layer 11 by aligning the continuous fibers "F" in a substantially parallel arrangement in the machine direction. This fabric layer 11 is then annealed at block 200 by heating it at a sufficient temperature and for a sufficient time to shrink and stabilize the fabric. For example, a nonwoven unidirectional fabric layer 11 according to the present disclosure made from Innegra® S yarn has a pre-anneal threshold temperature of approximately 220 deg. F., resulting in 1.5% shrinkage of the fabric. Generally, threshold temperatures for polyolefin based fabrics are in the range of 200 to 300 deg. F., and more particularly around 230 deg. F. The pre-annealing step 200 may be performed in a laminating machine, annealing one or more layers at a time. After the pre-anneal, the outside thermoplastic layer 14 may be applied to the annealed fabric layer 11 (block 300) using heat and pressure, or other suitable laminating means, to coat and secure the fabric layer 11 for subsequent processing (and handling). The steps indicated in blocks 100, 200 and 300 are then repeated (block 400) to form any desired number of additional pre-annealed fabric layers, including fabric layer 12. After annealing fabric layer 12, the outside thermoplastic layer 15 is applied as described above.

After forming the pre-annealed coated fabric layers 11, 12, one or more thermoplastic layers 15 may be placed between adjacent fabric layers 11, 12, as shown in FIG. 1, and the fabric layers 11, 12 cross-plied and laminated under heat and pressure (block 500) without further significant shrinkage of the fabric in the process. Alternatively, as shown in FIG. 2, the pre-annealed fabric layers 11', 12' may be cross-plied and laminated without additional thermoplastic, resin or other bonding agent between the layers. In either embodiment, the fabric layers 11, 12 (including layers 11', 12') may be cross-plied at 45 degrees, 90 degrees, or any other angle with respect to adjacent layers to create a unitary, integrally formed, dimensionally stable, ballistic laminate structure 10, 10'. The lamination steps may be performed at a temperature of between about 200 and 300 deg. F., and more particularly at about 240 deg. F.

Figure 4:
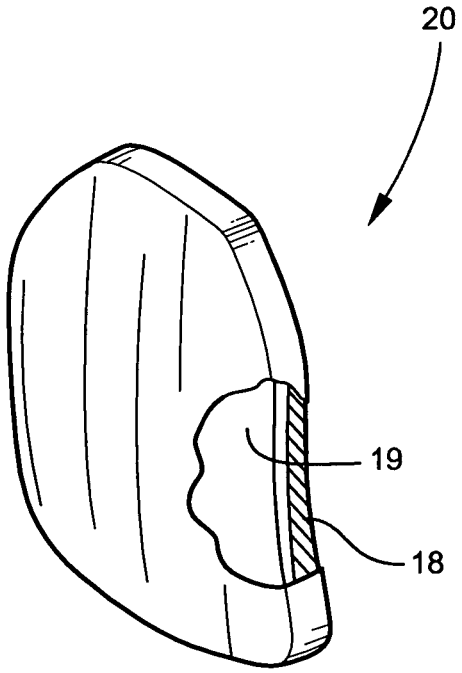
FIG. 4 is perspective view of an exemplary ballistic article incorporating multiple layers of the present ballistic laminate structure.

Multiple layers of the present ballistic structure 10, 10' thus formed may be loosely stacked, stitched together, or pressure-laminated together to form a thick, soft, ballistic fabric suitable for use in vehicle panels and soft body armor. Alternatively, multiple layers of the ballistic structure 10, 10' may be laminated together again under heat and pressure, including additional adhesive layers as required, to form a hard ballistic article suitable for use in body armor, helmets, cargo containers, and the like. FIG. 4 illustrates stacked layers of the ballistic laminate structure 10, 10' (FIGS. 1 and 2) comprising a unitary fabric backing 18 applied to a ceramic facing 19 in a military small arms protective insert (SAPI) 20. Other exemplary techniques for fabricating cross-plied ballistic fabric are disclosed in U.S. Pat. Nos. 5,437,905, 5,635,288; 5,935,678; 6,651,543; the contents of each of which are in their entirety incorporated by reference herein.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A ballistic laminate structure in sheet form, comprising:

a first pre-annealed fabric layer comprising a loosely assembled array of unidirectionally-oriented, untwisted, high performance fibers;

a second pre-annealed fabric layer comprising a loosely assembled array of unidirectionally-oriented, untwisted, high performance fibers; and means for joining said first and second pre-annealed fabric layers together at an angle to form a dimensionally stable cross-plied fabric.

2. A ballistic laminate structure according to claim 1, wherein said first pre-annealed fabric layer comprises high performance fibers annealed at a temperature sufficient to shrink said fabric layer in a machine direction.

3. A ballistic laminate structure according to claim 2, wherein said first pre-annealed fabric layer comprises high performance fibers annealed at a temperature sufficient to shrink said fabric layer at least 1.5% in a machine direction.

4. A ballistic laminate structure according to claim 1, wherein said second pre-annealed fabric layer comprises high performance fibers annealed at a temperature sufficient to shrink said fabric layer in a machine direction.

5. A ballistic laminate structure according to claim 4, wherein said second pre-annealed fabric layer comprises high performance fibers annealed at a temperature sufficient to shrink said fabric layer at least 1.5% in a machine direction.

6. A ballistic laminate structure according to claim 1, and comprising a thermoplastic layer residing outside of at least one of said first and second pre-annealed fabric layers.

7. A ballistic laminate structure according to claim 1, and comprising a thermoplastic layer residing between said first and second pre-annealed fabric layers.

8. A ballistic laminate structure according to claim 1, and comprising a thermoplastic layer residing adjacent at least one of said first and second pre-annealed fabric layers, said thermoplastic layer comprising a nonwoven fibrous heat-activated resin selected from a group consisting of polyethylene and ethylene-vinyl-acetate.

9. A ballistic laminate structure according to claim 1, wherein said first pre-annealed fabric layer is cross-plied at an angle of 90 degrees to said second pre-annealed fabric layer.

10. A ballistic laminate structure according to claim 1, wherein a percentage by weight of the high performance fibers in said ballistic laminate structure is at least 80 percent of a total weight of said ballistic laminate structure.

11. A ballistic laminate structure according to claim 1, wherein the fibers of said first and second pre-annealed fabric layers are chosen from a group consisting of aramid fiber, polyolefin, vinylon, and liquid crystal polymer-based fiber.

12. A ballistic laminate structure according to claim 1, wherein the fibers of said first and second pre-annealed fabric layers are chosen from a group consisting of extended chain ultra-high molecular weight polyethylene (UHMWPE), poly{p-phenylene-2,6-benzobisoxazole} (PBO), and poly{diimidazo pyridinylene(dihydroxy)phenylene} (M5).

13. A ballistic article comprising a stacked assembly of ballistic laminate structures, each ballistic laminate structure comprising:

a first pre-annealed fabric layer comprising a loosely assembled array of unidirectionally-oriented, untwisted, high performance fibers;

a second pre-annealed fabric layer comprising a loosely assembled array of unidirectionally-oriented, untwisted, high performance fibers; and means for joining said first and second pre-annealed fabric layers together at an angle to form a dimensionally stable cross-plied fabric.

14. A ballistic article according to claim 13, wherein said ballistic article comprises a small arms protective insert (SAPI).

15. A ballistic article according to claim 14, wherein said small arms protective insert comprises a ceramic facing.

16. A ballistic laminate structure according to claim 13, wherein said first pre-annealed fabric layer comprises high performance fibers annealed at a temperature sufficient to shrink said fabric layer in a machine direction.

17. A ballistic laminate structure according to claim 13, wherein said second pre-annealed fabric layer comprises high performance fibers annealed at a temperature sufficient to shrink said fabric layer in a machine direction.

18. A method for manufacturing a ballistic laminate structure in sheet form, said method comprising:

pre-annealing a first fabric layer comprising a loosely assembled array of unidirectionally-oriented, untwisted, high performance fibers;

pre-annealing a second fabric layer comprising a loosely assembled array of unidirectionally-oriented, untwisted, high performance fibers; and after pre-annealing the first and second fabric layers, joining the first and second fabric layers at an angle to form a dimensionally stable cross-plied fabric.

19. A method according to claim 18, wherein pre-annealing the first fabric layer comprises heating the fibers at a temperature sufficient to shrink the fabric layer in a machine direction.

20. A method according to claim 18, wherein pre-annealing the second fabric layer comprises heating the fibers at a temperature sufficient to shrink the fabric layer in a machine direction.

* * * * *